US008375637B2

(12) United States Patent
Zazula

(10) Patent No.: US 8,375,637 B2
(45) Date of Patent: Feb. 19, 2013

(54) GRAIN BIN LID ASSEMBLY

(76) Inventor: Bradley Metro Zazula, Burlington (CA)

( * ) Notice: Subject to any disclaimer, the term of this patent is extended or adjusted under 35 U.S.C. 154(b) by 18 days.

(21) Appl. No.: 13/178,251

(22) Filed: Jul. 7, 2011

(65) Prior Publication Data

US 2012/0317882 A1 Dec. 20, 2012

Related U.S. Application Data

(60) Provisional application No. 61/496,837, filed on Jun. 14, 2011.

(51) Int. Cl.
*E05F 11/00* (2006.01)

(52) U.S. Cl. ..... 49/357

(58) Field of Classification Search ..... 49/357, 49/386; 52/192, 19; 251/294, 299
See application file for complete search history.

(56) References Cited

U.S. PATENT DOCUMENTS 3,733,750 A * 5/1973 Hege ..... 49/379
4,208,839 A 6/1980 Candy
4,327,522 A 5/1982 Meadows
4,598,496 A * 7/1986 Van Daele ..... 49/357
4,625,888 A * 12/1986 Thompson ..... 220/262
4,744,183 A * 5/1988 Kruger ..... 52/192
4,747,244 A 5/1988 Christianson
5,218,784 A 6/1993 Pollock
5,839,597 A * 11/1998 Marttila ..... 220/264
8,196,362 B1 * 6/2012 Ratts ..... 52/192

FOREIGN PATENT DOCUMENTS

CA 1290913 10/1991

* cited by examiner

*Primary Examiner* — Jerry Redman
(74) *Attorney, Agent, or Firm* — Ryan W. Dupuis; Kyle R. SatterThwaite; Ade & Company Inc.

(57) ABSTRACT

A bin lid assembly includes a lid member arranged to span across an opening in the roof of a grain storage bin. The lid member is supported by a hinge which is biased towards a closed position extending forwardly across the bin opening from an open position extending rearwardly. An operating linkage is pivotally connected to the lid member and includes a opening arm which is folded relative to the lid member from a first position extending upwardly in the closed position of the lid member to a second position extending rearwardly in the open position of the lid member to allow the lid member to be opened 180 degrees. The linkage also allows a mechanical advantage to be maintained when pulling the lid open using an actuator tether alongside the bin which is connected at an upper end to the opening arm.

15 Claims, 3 Drawing Sheets

GRAIN BIN LID ASSEMBLY

This application claims the benefit under 35 U.S.C. 119(e) of U.S. provisional application Ser. No. 61/496,837, filed Jun. 14, 2011.

FIELD OF THE INVENTION

The present invention relates to a lid assembly for a grain bin, and more particularly the present invention relates to a grain bin lid including an opening linkage coupled to the lid and a tether extending downwardly alongside the bin from the linkage to the ground for opening the lid.

BACKGROUND

When filling a grain bin, typically the bin opening at the top of the bin must first be opened so that the discharge of a grain conveyor can be aligned with the opening and discharge conveyed material into the bin. Due to the considerable height of the top of the grain bin, various linkages are known to allow users to open a lid spanning the bin opening using a cable or tether connected between the lid and the ground through the linkage.

Examples of tethered linkages for opening a grain bin lid are disclosed in U.S. Pat. No. 4,208,839 by Candy, Sr.; U.S. Pat. No. 4,327,522 by Meadows; U.S. Pat. No. 4,747,244 by Christianson; and U.S. Pat. No. 4,598,496 by VanDaele. In each of these examples however, the linkage is only able to open the lid through a range of approximately 90 degrees. Accordingly the lid extends upwardly above the bin opening and can readily become damaged by contact with a discharge of a conveyor while attempting to align the conveyor with the bin opening.

Canadian Patent No. 1,290,913 by Koenders discloses a bin lid which is displaced generally laterally form the closed position to the open position. Due to the lateral motion require by the linkage to open the lid, it is difficult to provide a mechanical advantage to the opening motion such that the lid can be difficult to open at times.

U.S. Pat. No. 5,218,784 discloses a further example of a bin lid operating by a linkage to open the bin lid. A lever arm supports pulleys thereon such that the cable can be connected directly to the lid member while the lever arm acts to redirect the pulling force on the cable. The linkage requires alignment of the cable with the pulleys which must be well maintained otherwise the cable may become misaligned with the pulley so that the linkage is no longer effectively at operating the bin lid between open and closed position.

SUMMARY OF THE INVENTION

According to one aspect of the invention there is provided a bin lid assembly for association with a bin opening of an agricultural particulate material storage bin including a peripheral side wall and a roof supported on the side wall which locates the bin opening therein, the bin lid assembly comprising:

a lid member arranged to span across the bin opening;

a hinge arranged to support the lid member on the bin for pivotal movement about a hinge axis offset to one side of the bin opening between a closed position in which the lid member extends forwardly across the bin opening from the hinge axis and an open position in which the lid member is pivoted through a range of approximately 180 degrees relative to the closed position such that the lid member extends rearwardly from the hinge axis away from the bin opening in the open position;

a biasing member arranged to bias the lid member towards the closed position;

an operating linkage pivotally connected to the lid member;

an actuator tether arranged to extend alongside the bin to an upper end arranged for connection to the operating linkage;

the operating linkage including an opening arm extending in a longitudinal direction between an inner end of the opening arm which is pivotally connected to the lid member and an outer end of the opening arm which is opposite the inner end so as to be arranged for connection to the upper end of the actuator tether;

the opening arm being supported for pivotal movement with the operating linkage relative to the lid member between a first position in the closed position of the lid member in which the opening arm extends generally upwardly away from the lid member from the inner end to the outer end and a second position in the open position of the lid member in which the opening arm extends generally rearward from the inner end to the outer end.

The configuration of the opening arm to rotate in orientation relative to the lid member allows the opening arm to fold in upon itself under the lid member as the lid member is pivoted into the open position such that the opening arm and linkage do not interfere with opening of the lid member through a full range of 180 degrees. The opening arm can thus be arranged to remain well oriented through the full range of motion of the lid member to maintain a mechanical advantage to open the lid member against the biasing member.

Preferably the opening arm extends upwardly at a rearward inclination in the first position from the inner end to the outer end when the lid member is in the closed position.

Preferably the outer end of the opening arm in the first position is spaced directly above an inner end of the lid member closest to the hinge in the closed position.

Preferably the opening arm remains oriented to extend generally rearward from the inner end to the outer end through the range of motion of the lid member between the closed and open positions and the corresponding range of motion of the opening arm relative to the lid member between the first and second positions.

Preferably the opening arm extends rearward at a downward inclination in the second position from the inner end to the outer end when the lid member is in the open position.

Preferably the linkage includes a stop member arranged to engage the opening arm in the first position so as to be arranged to prevent pivotal movement of the opening arm relative to the lid member beyond the first position in a direction away from the second position.

In the illustrated embodiment, the linkage comprises a four bar linkage including a first link pivotally coupled to an inner end of the lid member closest to the hinge, a second link pivotally coupled to the lid member at a location spaced from the hinge axis, and the opening arm pivotally coupled to the first link and the second link at spaced apart locations thereon.

Preferably the stop member is supported on the second link so as to be arranged to engage the opening arm in the first position.

Preferably a pivotal connection of the second link to the lid member is at a location spaced forwardly and above a pivotal connection of the first link to the lid member in the closed position of the lid member.

In the illustrated embodiment an axis extending between the pivotal connection of the first link to the lid member and the pivotal connection of the second link to the lid member is arranged to be substantially parallel to a slope of the roof of the grain bin between the side wall and the bin opening in the open position of the lid member.

Preferably in the first position of the linkage and the closed position of the lid member the first link extends upwardly from the lid member at a forward inclination, the second link extends upwardly from the lid member at a rearward inclination and the opening arm extends upwardly at a rearward inclination from a pivotal connection to the second link to a pivotal connection to the first link.

The first link may be longer between respective pivotal connections than combined lengths of the second link and the opening arm between their respective pivotal connections.

Preferably the opening arm and the second link are substantially parallel to one another in the first position.

Preferably in the second position of the linkage and the open position of the lid member the first link extends rearwardly at a downward inclination from the lid member, the second link extends upwardly at a forward inclination from a pivotal connection to the lid member and the opening arm extends downwardly and rearwardly from a pivotal connection to the second link to a pivotal connection to the first link.

The first link may be curved about a pivotal connection between the opening arm and the second link in the second position.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
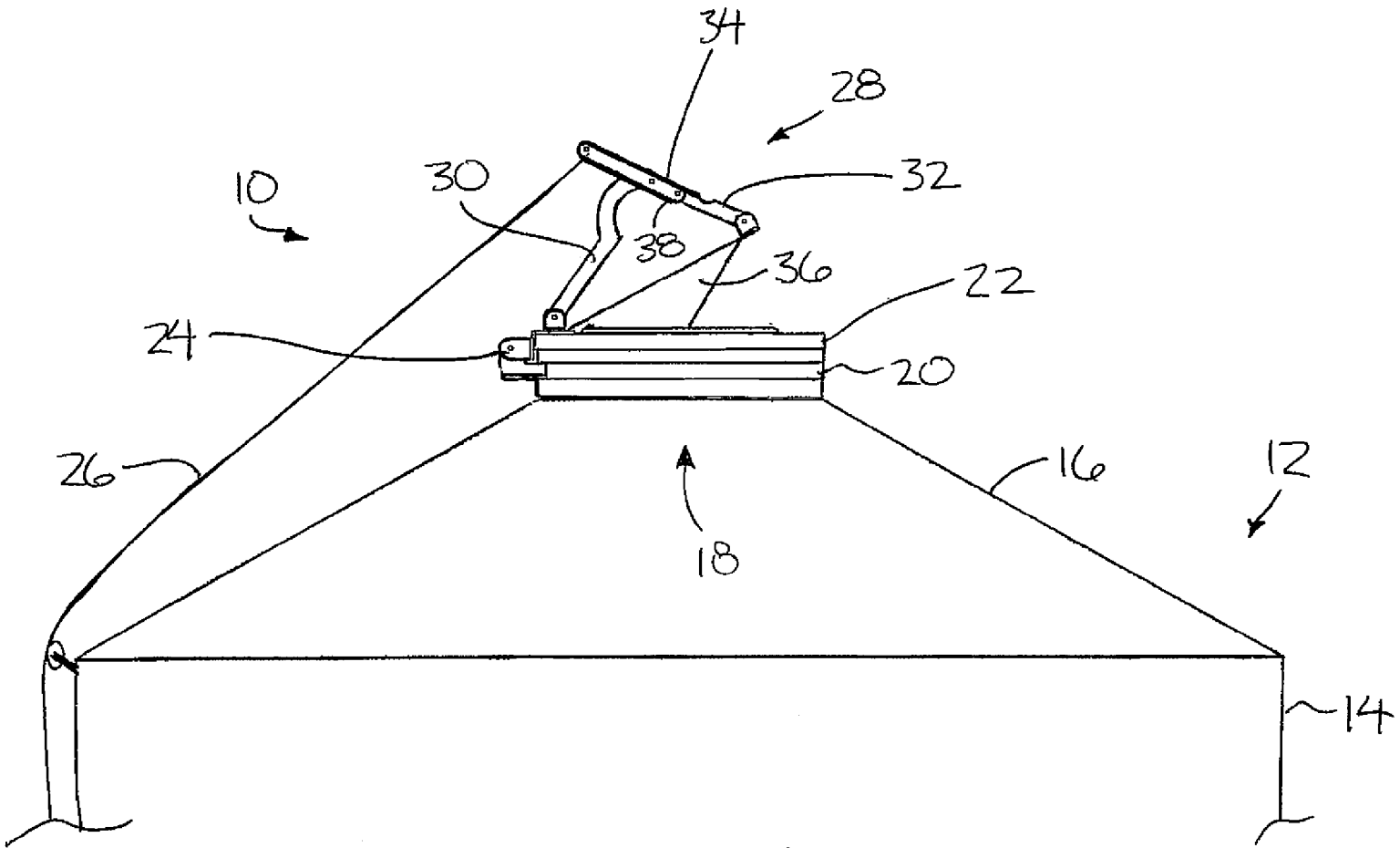
FIG. 1 is a side elevational view of the bin lid assembly on a grain bin in a closed position of the lid member corresponding to a first position of the linkage relative to the lid member.

Referring to the accompanying figures, there is illustrated a bin lid assembly generally indicated by reference numeral 10. The lid assembly is particularly suited for use with a grain bin 12 for example a grain storage bin comprising a cylindrical peripheral side wall 14 extending vertically upward from a bottom end to a roof 16 spanning the top end. The roof typically comprises an inverted cone shape which tapers upwardly and inwardly to a bin opening 18 centrally located at the top end of the lid. A generally cylindrical collar 20 is mounted about the opening to define a generally horizontal plane of the opening.

The assembly 10 includes the lid member 22 of the bin in which the lid member is a generally fiat circular member having an outer diameter which is greater than the opening so as to be arranged to fully span and cover the opening in use. The lid member 22 is coupled at one side of the collar 20 of the bin opening such that the lid member is pivotal relative to the roof of the bin about a horizontal hinge axis at one side of the bin opening. The lid member 22 is supported for pivotal movement about the hinge axis through a range of approximately 180 degrees between a closed position and an open position. In the closed position, the lid member is generally horizontal and extends forwardly from an inner end at the hinge axis to an opposing outer end farthest from the axis. The lid member thus fully encloses the bin opening in the closed position. In the open position, the lid member is pivoted 180 degrees from the closed position so as to be also generally horizontal but extending rearwardly in relation to the hinge axis from the inner end to the outer end of the lid member.

A coil spring is incorporated into the hinge 24 to act as a biasing member which biases the lid member from the open position back to the closed position. A tether actuator 26 is provided for connection to the lid member through an operating linkage 28 of the lid assembly. The tether actuator comprises an elongate tether, cable or chain which extends alongside the side wall of the bin from a bottom end adjacent the ground for actuation by the user to an upper end connected to the operating linkage connected to the lid member above the roof of the bin.

The operating linkage comprises a four bar linkage including a first link 30 pivotally coupled relative to the lid member, a second link 32 pivotally coupled relative to the lid member spaced from the first link coupling, and an intermediate link 34 coupled between the first link 30 and the second link 32.

The first link is pivotally connected at an inner end directly to the lid member at the inner end nearest to the hinge axis. The first link extends outward from the hinge axis to an opposing outer end pivotally connected to the intermediate link 34.

The second link is similarly pivotally connected at the inner end thereof to the lid member while the outer end is pivotally connected on the intermediate link at a location spaced from the pivotal connection to the first link. A mounting plate 36 is coupled to the top side of the lid member to pivotally support the pivot connection of the second link 32 to the lid member thereon at a location which is spaced upwardly and forwardly from the pivotal connection of the first link at the inner end when the lid member is in a closed position.

The mounting plate 36 is an upright plate fixed relative to the lid member which is generally triangular in shape. One side of the triangular plate is fixed horizontally along the top of the lid member in the closed position. Another side of the triangular plate extends at an upward and forward inclination when the lid is closed between the pivotal connection of the first link and the pivotal connection of the second link on the lid member. The third side of the triangular plate extends between the pivot connection of the second link and the lid member.

The first link 30 is longer between the pivot connections at the opposing inner and outer ends thereof than the combined length of the second link between the respective pivots thereof and the intermediate link 34 between the respective pivots thereof.

The intermediate link is arranged to extend linearly outward along a common axis which locates the pivotal connections of the first and second links to the intermediate link. The intermediate link 34 thus defines an opening arm which is elongate between an inner end locating the pivotal connection of the second link 32 thereon to an opposing outer end arranged to be connected to the upper end of the tether actuator 26. The pivotal connection of the first link is located at an intermediate position between the inner and outer ends of the intermediate link defining the opening arm.

The operating linkage is arranged for pivotal movement relative to the lid member between a first position and a second position.

The operating linkage is in the first position when the lid is closed such that the first link extends upwardly and forwardly from the inner end connected to the lid member to the outer end connected to the intermediate link while the second link extends upwardly at a rearward inclination from the inner end pivotally connected to the lid member to the outer end pivotally connected to the intermediate link. In the first position of the linkage corresponding to the closed position of the lid, the opening arm is generally parallel and aligned along a common axis as the second link so that the opening arm extends upwardly and rearwardly to the outer end spaced directly above the inner end of the lid member closest to the hinge axis.

In the closed position, the tether is connected to the outer end of the opening arm so as to extend rearward therefrom across the roof of the bin and down the side of the bin. Pulling on the tether thus urges the opening arm beyond the first position that is shown in FIG. 1; however, a stop member 38 is fixed to the second link for engaging one side of the opening arm between the pivotal connections thereon to prevent the pivoting of the linkage beyond the first position away from the second position. Pulling on the tether to open the lid thus maintains the linkage in the first position relative to the lid member and instead pivots the whole lid member and linkage together until the lid is near the intermediate position shown in FIG. 2 in which the lid has been pivoted through a range of approximately 90 degrees.

The operating linkage is arranged to be pivoted into the second position only when as the lid approaches the open position. In the second position, the first link extends downwardly at a rearward inclination so as to be substantially parallel to the outer side of the mounting plate 36 connected between the pivotal connections of the first and second links on the lid member. The first link is generally parallel to the downward slope of the roof so that the linkage can be brought into alignment along the roof so as not to interfere with pivoting of the lid member fully through a range of 180 degrees instead of interference of the linkage with the roof member as in some prior art configurations. Furthermore in the second position of the operating linkage corresponding to the open position of the lid, the second link member extends upwardly and forwardly from the inner end to the outer end thereof such that the second link is also substantially parallel to the roof slope and the first link.

Due to the length of the first link being near to the length of the distance between the first and second link pivot connections on the link member, the resulting orientation of the link members in the second position causes the pivot connection between the opening arm and the second link to be located between the pivot connections at opposing ends of the first link. The outer end of the first link is accordingly curved in shape so as to be arranged to curve around the bottom side of the opening arm and second link pivot connection located between opposing ends of the first link in the second position of FIG. 3.

Due to the overlap of the first and second links, the resulting orientation of the opening arm is generally downward and rearward in the second position of the linkage and open position of the lid so that the opening arm is also near parallel to the first link and the roof slope. The second link similarly includes a curved recess formed along one side thereof such that the second link curves around and over the pivot connection between the first link and opening arm in the second position of the operating linkage shown in FIG. 3.

Figure 2:
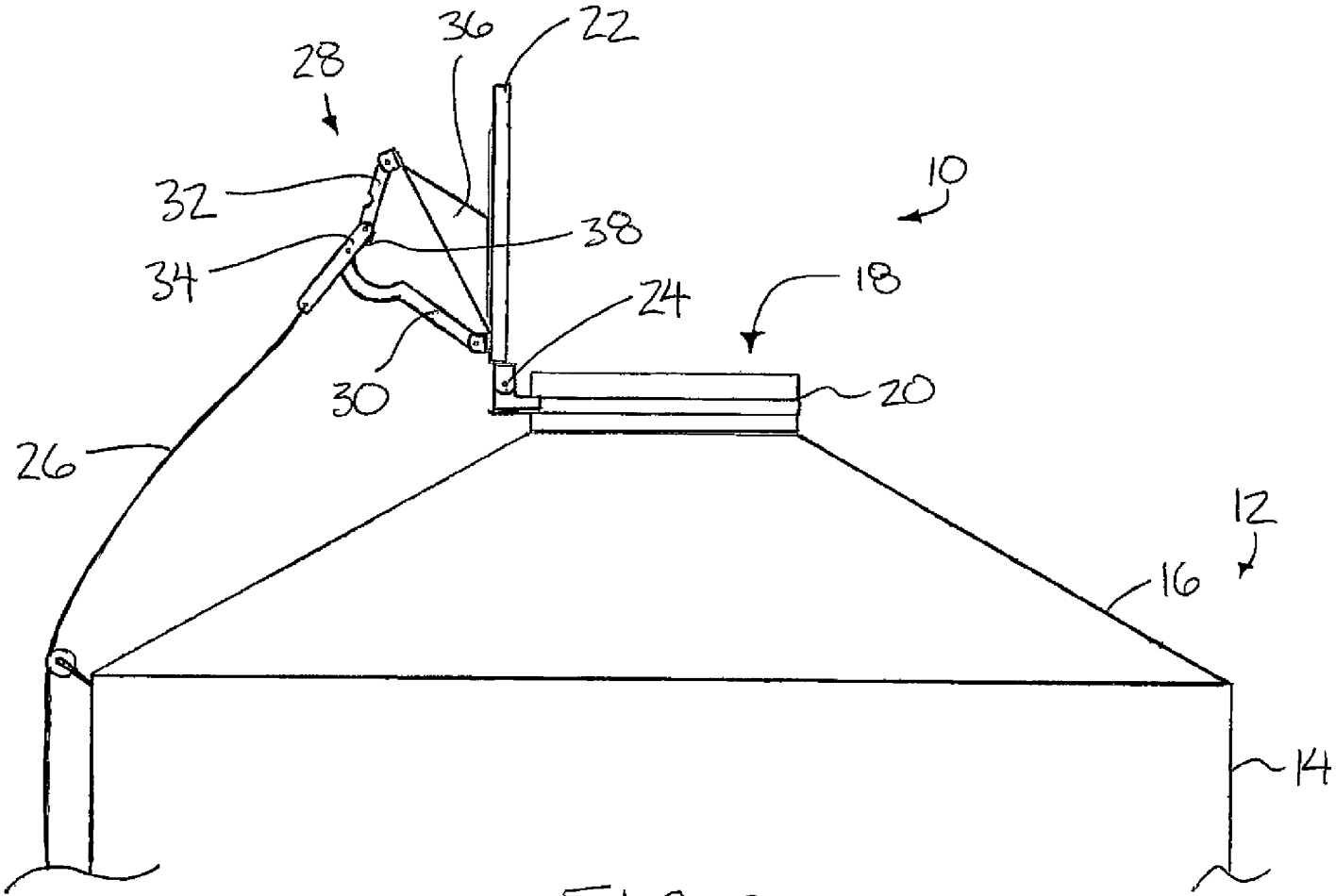
FIG. 2 is a side elevational view of the bin lid assembly on a grain bin in an intermediate position between the open and closed positions of the lid member.
Figure 3:
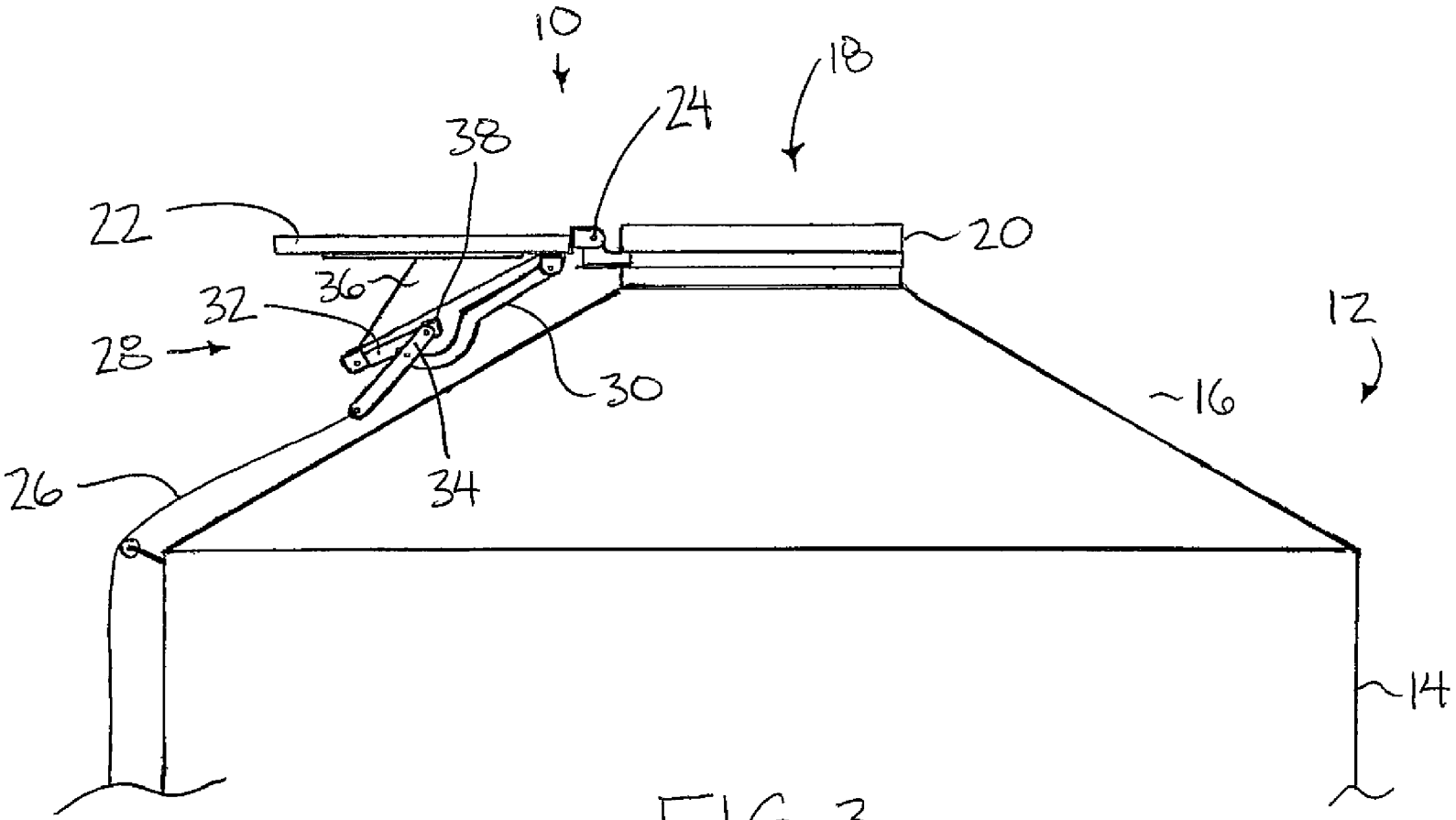
FIG. 3 is a side elevational view of the bin lid assembly on a grain bin in an open position of the lid member corresponding to a first position of the linkage relative to the lid member.

As shown in FIGS. 1 through 3, opening of the lid is accomplished by pulling the tether such that the tether pulls the operating linkage from the first position through to the second position as the lid is opened from the closed position to the open position. The opening arm rotates in orientation about a horizontal axis parallel to the hinge axis through an obtuse angle range relative to the lid member. The opening arm thus remains oriented from the inner end to the outer end in a generally rearward orientation throughout the full range of motion of the lid pivoting between the open and closed positions.

As shown in FIG. 1, initially pulling the tether connected to the outer end of the opening arm in a rearward direction causes the opening arm to be pivoted against the stop on the second link so that the linkage remains in the first position relative to the lid as the lid is pivoted through near 90 degrees of rotation to an intermediate position as shown in FIG. 2. Once the lid member is rotated over center, the downward and rearward pulling force of the tether which is near to the roof slope begins to pivot the opening arm from the first position to the second position. Due to the opening arm remaining in the first position through the first 90 degrees of rotation, the user pulling on the tether maintains a mechanical advantage to leverage pivoting of the lid member against the biasing force of the spring as the lid is opened. The linkage is arranged such that the opening arm begins to fold back against the lid member through the second 90 degrees of rotation such that the tether pulling on the opening arm continues to pull from the outer end of the lid member and maintain mechanical advantage through the remaining 90 degrees of rotation to the open position.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A bin lid assembly for association with a bin opening of an agricultural particulate material storage bin including a peripheral side wall and a roof supported on the side wall which locates the bin opening therein, the bin lid assembly comprising:

a lid member arranged to span across the bin opening;

a hinge arranged to support the lid member on the bin for pivotal movement about a hinge axis offset to one side of the bin opening between a closed position in which the lid member extends forwardly across the bin opening from the hinge axis and an open position in which the lid member is pivoted relative to the closed position such that the lid member extends rearwardly from the hinge axis away from the bin opening in the open position;

a biasing member arranged to bias the lid member towards the closed position;

an operating linkage pivotally connected to the lid member;

an actuator tether arranged to extend upwardly alongside the bin towards an upper end of the actuator tether which is arranged for connection to the operating linkage;

the operating linkage including an opening arm extending in a longitudinal direction between an inner end of the opening arm which is pivotally connected to the lid member and an outer end of the opening arm which is opposite the inner end so as to be arranged for connection to the upper end of the actuator tether;

the opening arm being supported for pivotal movement with the operating linkage relative to the lid member between a first position in the closed position of the lid member in which the opening, arm extends generally upwardly away from the lid member from the inner end to the outer end and a second position in the open position of the lid member in which the opening arm extends generally rearward in relation to the hinge axis from the inner end of the opening arm to the outer end of the opening arm.

2. The bin lid assembly according to claim 1 wherein the opening arm extends upwardly at a rearward inclination in the first position from the inner end to the outer end when the lid member is in the closed position.

3. The bin lid assembly according to claim 1 wherein the outer end of the opening arm in the first position is spaced directly above an inner end of the lid member closest to the hinge in the closed position.

4. The bin lid assembly according to claim 1 wherein the opening arm remains oriented to extend generally rearward from the inner end to the outer end through the range of motion of the lid member between the closed and open positions and the corresponding range of motion of the opening arm relative to the lid member between the first and second positions.

5. The bin lid assembly according to claim 1 wherein the opening arm extends rearward at a downward inclination in the second position from the inner end to the outer end when the lid member is in the open position.

6. The bin lid assembly according to claim 1 wherein the linkage includes a stop member arranged to engage the opening arm in the first position so as to be arranged to prevent pivotal movement of the opening arm relative to the lid member beyond the first position in a direction away from the second position.

7. The bin lid assembly according to claim 1 wherein the linkage comprises a four bar linkage including a first link pivotally coupled to an inner end of the lid member closest to the hinge, a second link pivotally coupled to the lid member at a location spaced from the hinge axis, and the opening arm pivotally coupled to the first link and the second link at spaced apart locations thereon.

8. The bin lid assembly according to claim 7 wherein the linkage includes a stop member supported on the second link so as to be arranged to engage the opening arm in the first position and arranged to prevent pivotal movement of the linkage relative to the lid member beyond the first position in a direction away from the second position.

9. The bin lid assembly according to claim 7 wherein a pivotal connection of the second link to the lid member is at a location spaced forwardly and above a pivotal connection of the first link to the lid member in the closed position of the lid member.

10. The bin lid assembly according to claim 9 wherein an axis extending between the pivotal connection of the first link to the lid member and the pivotal connection of the second link to the lid member is arranged to be substantially parallel to a slope of the roof of the grain bin between the side wall and the bin opening in the open position of the lid member.

11. The bin lid assembly according to claim 7 wherein in the first position of the linkage and the closed position of the lid member the first link extends upwardly from the lid member at a forward inclination, the second link extends upwardly from the lid member at a rearward inclination and the opening arm extends upwardly at a rearward inclination from a pivotal connection to the second link to a pivotal connection to the first link.

12. The bin lid assembly according to claim 11 wherein the first link is longer between respective pivotal connections than combined lengths of the second link and the opening arm between their respective pivotal connections.

13. The bin lid assembly according to claim 11 wherein the opening arm and the second link are substantially parallel to one another in the first position.

14. The bin lid assembly according to claim 13 wherein the first link is curved about a pivotal connection between the opening arm and the second link in the second position.

15. The bin lid assembly according to claim 7 wherein in the second position of the linkage and the open position of the lid member the first link extends rearwardly at a downward inclination from the lid member, the second link extends upwardly at a forward inclination from a pivotal connection to the lid member and the opening arm extends downwardly and rearwardly from a pivotal connection to the second link to a pivotal connection to the first link.

* * * * *